US007587792B2

(12) United States Patent
Schmitz

(10) Patent No.: US 7,587,792 B2
(45) Date of Patent: Sep. 15, 2009

(54) APPARATUS AT A FLAT CARD FOR COTTON, SYNTHETIC FIBERS OR THE LIKE, HAVING A CARDING ELEMENT

(75) Inventor: Thomas Schmitz, Mönchengladbach (DE)

(73) Assignee: Truetzschler GmbH & Co. KG, Moenchengladbach (DE)

( * ) Notice: Subject to any disclaimer, the term of this patent is extended or adjusted under 35 U.S.C. 154(b) by 330 days.

(21) Appl. No.: 11/638,346

(22) Filed: Dec. 14, 2006

(65) Prior Publication Data

US 2008/0010781 A1 Jan. 17, 2008

(30) Foreign Application Priority Data

Jan. 26, 2006 (DE) ..... 10 2006 003 958

(51) Int. Cl.
*D01G 15/24* (2006.01)

(52) U.S. Cl. ..... 19/113; 19/102; 19/104

(58) Field of Classification Search ..... 19/102, 19/104, 110, 111, 113
See application file for complete search history.

(56) References Cited

U.S. PATENT DOCUMENTS

| | | | | |
|---|---|---|---|---|
| 565,554 | A * | 8/1896 | Mills | 19/113 |
| 4,825,511 | A * | 5/1989 | Stewart et al. | 19/85 |
| 4,974,295 | A | 12/1990 | Demuth et al. | |
| 4,996,745 | A | 3/1991 | Sutcliffe | |
| 5,467,505 | A | 11/1995 | Graf | |
| 6,101,681 | A * | 8/2000 | Patelli et al. | 19/104 |
| 6,564,430 | B2 * | 5/2003 | Graf | 19/98 |
| 2002/0157216 | A1 | 10/2002 | Graf | |

FOREIGN PATENT DOCUMENTS

| | | |
|---|---|---|
| DE | 37 33 094 C2 | 4/1989 |
| DE | 94 19 619 U1 | 3/1995 |
| EP | 0 378 807 B1 | 7/1990 |
| GB | 1 353 735 A | 5/1974 |
| GB | 1 543 334 A | 4/1979 |
| GB | 2 032 477 A | 5/1980 |

OTHER PUBLICATIONS

German Search Report with English Translation dated Jun. 14, 2006, issued in DE 10 2006 003 958.
United Kingdom Search Report dated May 4, 2007, issued in Application No. GB0701269.3.

* cited by examiner

*Primary Examiner*—Shaun R Hurley
(74) *Attorney, Agent, or Firm*—Venable LLP; Robert Kinberg; Justine A. Gozzi

(57) ABSTRACT

In an apparatus at a flat card for cotton, synthetic fibres and the like, wherein at least one stationary carding element comprising a carrying element with at least one clothing element is associated with a clothed roller, for example a cylinder, the tips of the clothing elements and the tips of the clothing of the roller lie opposite one another with a spacing and the carrying element has a hollow space. In order for the carrying element to be dimensionally stable in operation even when exposed to heat, the cross-sectional shape of the carrying element does not include an enclosed hollow space, and the opening is arranged in a region remote from the tips of the clothing element.

19 Claims, 3 Drawing Sheets

APPARATUS AT A FLAT CARD FOR COTTON, SYNTHETIC FIBERS OR THE LIKE, HAVING A CARDING ELEMENT

CROSS REFERENCE TO RELATED APPLICATION

This application claims priority from German Patent Application No. 10 2006 003 958.0 dated Jan. 26, 2006, the entire contents of which are incorporated herein by reference.

BACKGROUND OF THE INVENTION

The invention relates to an apparatus at a flat card for cotton, synthetic fibres and the like, wherein at least one stationary carding element comprising a carrying element with at least one clothing element is associated with a clothed roller, for example a cylinder.

Fixed carding elements are increasingly being used in textile machines, especially in roller cards and flat cards. These fixed carding elements consist of a profiled carrier member and clothing strips attached thereto (1 to 3 strips per profiled carrier member). The profiled carrier members for fixed carding elements are currently made in the form of profiled members of extruded aluminum which are enclosed on all sides. In the case of a known apparatus (GB 1 543 334), the carrier element is a hollow profiled member, the cross-sectional shape of which includes an enclosed hollow space. Disregarding the two end faces, the hollow space is completely surrounded over its length by enclosed wall surfaces. The heat produced during the carding process is to a large extent removed by way of the fixed carding elements to the outside, the temperature gradient required for the purpose within the cross-section of the profiled member resulting in deformation of the fixed carding element. The greater that gradient, the greater is the deformation. In the case of profiled member cross-sections which are enclosed on all sides, relatively large temperature gradients occur, giving rise to undesirably large deformations. In addition, the enclosed pockets of air have a disadvantageous effect in the case of those profiled members, causing the profiled members to act like thermal insulation and to raise the temperature level of the cylinder and of adjacent components.

It is an aim of the invention to provide an apparatus of the kind described at the beginning that avoids or mitigates the mentioned disadvantages and especially wherein the carrier element is dimensionally stable in operation even when exposed to heat.

SUMMARY OF THE INVENTION

The invention provides an apparatus for use at a carding machine, comprising a carrying element and one or more clothing elements with clothing tips, the carrying element having a front portion with said one or more clothing elements, and a rear portion, which together with the front portion defines a partially enclosed void region, wherein the rear portion includes, in a region remote from the clothing tips of the clothing elements, an opening communicating with the void region.

As a result of the measures in accordance with the invention, a considerable proportion of the heat is removed to the outside so that the carrier element remains dimensionally stable in operation even when exposed to heat. It is advantageous that the profiled member cross-section is open to the outside. As a result, the temperature gradient and the deformation produced thereby are drastically reduced. In addition, the profiled member according to the invention, having open cross-sections and an optimised mass distribution, brings about better removal of heat (cooling rib effect) and so reduces the temperature level of the cylinder and of adjacent components. The thermal expansion of the components of the flat card is reduced.

The carrying element may be, for example, a semi-hollow profiled member. Advantageously, the void region is not completely enclosed. In one embodiment, the cross-section of the carrying element is substantially U-shaped.

Advantageously, the void region is open to the outside on the side which is remote from the tips of the clothing elements.

In one embodiment, the opening of the hollow space is continuous over the width of the machine. In another embodiment, the opening of the hollow space consists of at least two sub-openings. The or each opening of the hollow space is advantageously slot-shaped.

It is preferred that no covering is present on the open end region of the side walls, whereby the void region is open at one or both ends of the carrying element. In certain embodiments, the carrying element consists of two side walls and a clothing mounting part. The carrying element may be a profiled member element, which may be extruded, for example, of aluminum or an aluminum alloy.

In certain embodiments, at least one rib or the like may be arranged in the interior of the void region. Where present, the ribs advantageously extend in the longitudinal direction of the carrying element. The ribs, where present, may be arranged to serve as cooling ribs and/or to serve as strengthening ribs. It is preferred that the material cross-section of the carrying element gives rise to a substantially homogeneous temperature distribution with a small thermal gradient. Where present, ribs may be of a height selected such that the ribs promote a substantially homogenous temperature distribution and/or the distribution (position) of the ribs may be selected so as to promote a substantially homogenous temperature distribution. In certain preferred embodiments, the mass distribution of the material is so arranged that the mass to be heated becomes less towards the outside. The surface in contact with the atmosphere on the outside can give rise to an increase in thermal convection with enlargement of the surface area. Suitable materials for use as the material for the carrying element including those having at least one or preferably more than one of the following characteristics:

a high thermal conductivity;

a low coefficient of linear expansion.

In another embodiment of the invention, there is provided an apparatus at a carding machine for cotton, synthetic fibres and the like, wherein at least one stationary carding element comprising a carrying element with at least one clothing element is associated with a clothed roller, for example a cylinder, wherein the tips of the clothing elements and the tips of the clothing of the roller lie opposite one another with a spacing, and wherein the carrying element has a hollow space, in which the cross-sectional shape of the carrying element includes a hollow space which is not enclosed, the hollow space having an opening which is arranged in a region remote from the tips of the clothing element.

DETAILED DESCRIPTION OF PREFERRED EMBODIMENTS

Figure 1:
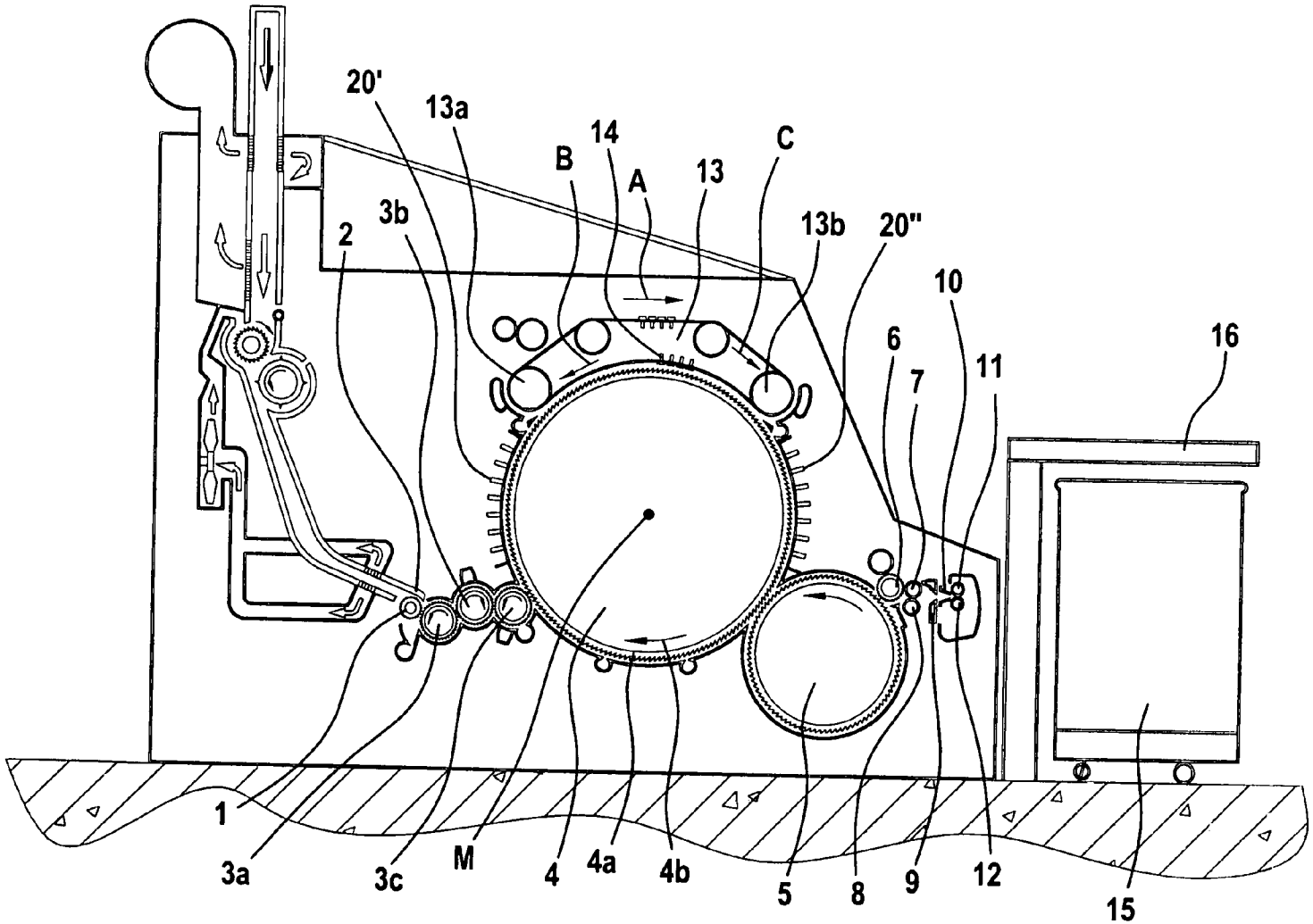
FIG. 1 is a diagrammatic side view of a flat card having one form of apparatus according to the invention.

FIG. 1 shows a flat card, for example a Trützschler TC 03 (Trade Mark) flat card, having a feed roller 1, feed table 2, lickers-in 3*a*, 3*b*, 3*c*, cylinder 4, doffer 5, stripper roller 6, nip rollers 7, 8, web-guiding element 9, web funnel 10, delivery rollers 11, 12, revolving card top 13 having card top guide rollers 13*a*, 13*b* and flats 14, can 15 and can coiler 16. The directions of rotation of the rollers are indicated by curved arrows. Reference letter M denotes the centre (axis) of the cylinder 4. Reference numeral 4*a* denotes the clothing and reference numeral 4*b* denotes the direction of rotation of the cylinder 4. The arrow A indicates the working direction. The arrows B, C denote the direction of movement of the flats 14 in revolving card top 13. The flat card according to FIG. 1 is provided with has a number of fixed carding elements 20', 20", which may be of one or more of the kinds shown in FIG. 2, FIG. 3 or FIG. 4 or may be of any other construction according to the invention.

Figure 2:
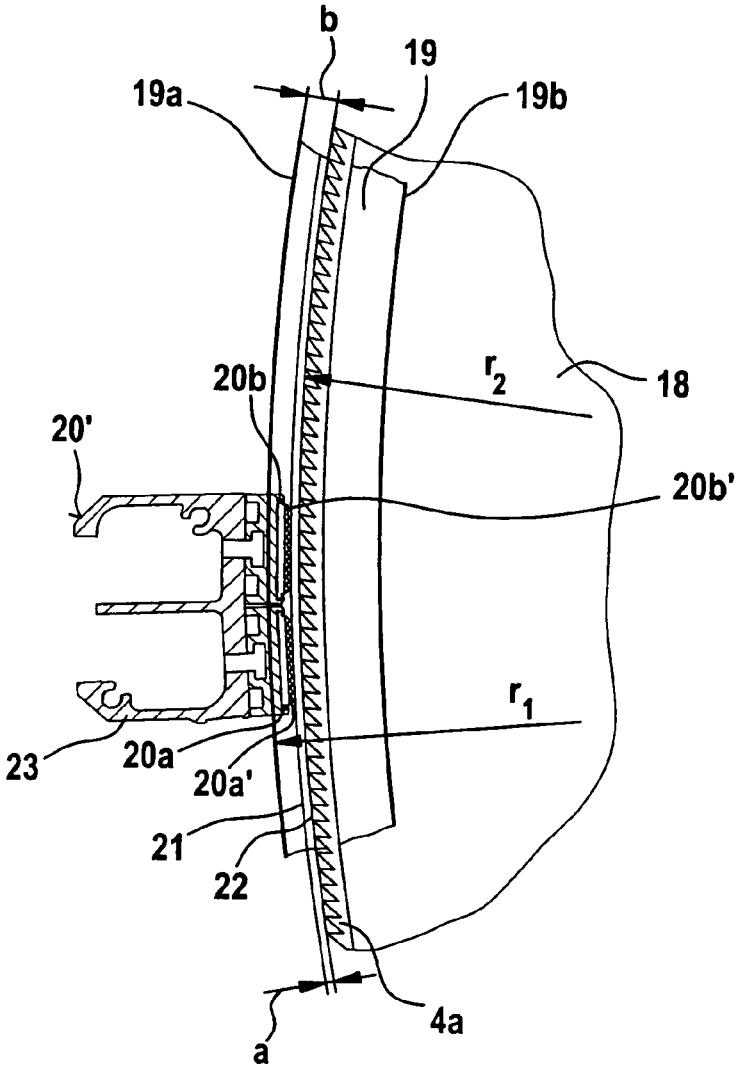
FIG. 2 shows a carding segment according to a first embodiment of the invention and part of a side screen, with spacing between the clothing of the carding segment and the clothing of the cylinder.
Figure 2A:
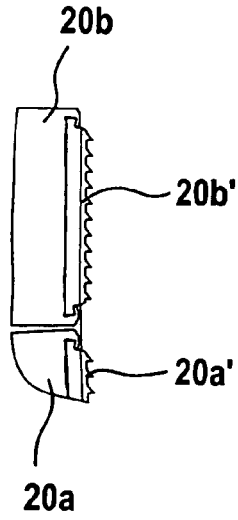
FIG. 2*a* shows the carding elements according to FIG. 2 in detail.

In the exemplary embodiment of FIG. 2, a flat card of the kind shown in FIG. 1 has an approximately semi-circular, rigid side panel 18, which is fixed laterally to the machine frame (not shown) on each side of the flat card. On the outside of the panel in the region of the periphery there is integrally cast in a concentric position a rigid arcuate supporting element 19, which has, as supporting surface, a convex outer surface 19*a* and an underside 19*b*. In this embodiment, the apparatus according to the invention comprises in each case at least one fixed carding element 20'having at both its ends mounting surfaces, which are mounted on the convex outer surface 19*a* of the mounting element (for example, extension bend). Fixed to the underneath surface of the fixed carding element 20'are carding elements 20*a*, 20*b* having clothing strips 20*a*', 20*b*' (carding clothings—see FIG. 2*a*). Reference numeral 21 denotes the circle of tips of the clothing strips 20*a*', 20*b*'. The cylinder 4 has, around its circumference, a cylinder clothing 4*a*, for example a saw-tooth clothing. Reference numeral 22 denotes the circle of tips of the cylinder clothing 4*a*. The spacing between the circle of tips 21 and the circle of tips 22 is indicated by the reference letter a and is, for example, 0.20 mm. Reference letter b denotes the spacing between the convex outer surface 19*a* and the circle of tips 22. Reference $r_1$ denotes the radius of the convex outer surface 19*a*and reference $r_2$ denotes the radius of the circle of tips 22. The radii $r_1$ and $r_2$ intersect in the centre M of the cylinder 4. The carding segment 20' according to FIG. 2 has a carrying element 23 (profiled carrier member) and two carding elements 20*a*, 20*b*, which are arranged one after the other in the direction of rotation (arrow 4*b*) of the cylinder 4, the clothing strips 20*a*', 20*b*' of the carding elements 20*a*, 20*b* and the clothing 4*a* of the cylinder 4 lying opposite one another. The carrier member 23 consists of an aluminum hollow profiled member and has continuous hollow spaces (23$g_1$, 23$g_2$, see the variant in FIG. 4).

Figure 3:
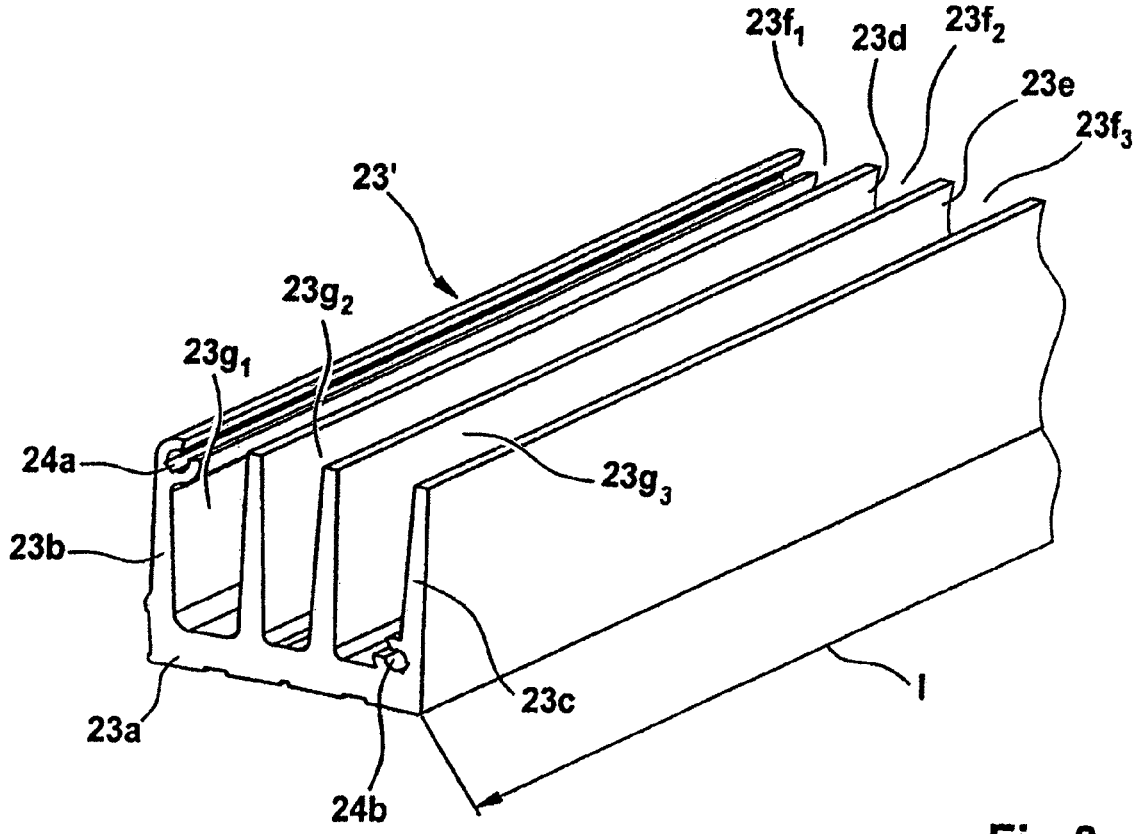
FIG. 3 is a perspective view of an end portion of a carrying element of an apparatus according to a second embodiment of the invention, the carrying element having two longitudinal ribs in the interior (hollow space)

In the embodiment of FIG. 3, the carrying element 23' (profiled carrier member) consists of a bottom part in the form of a base plate 23*a* and two side walls 23*b*, 23*c*, altogether being substantially U-shaped in cross-section. The side walls 23*b*, 23*c* rise up from the two outside longitudinal edges of the base plate 23*a*. Rising up within the interior 23*g* (hollow space) of the carrying element 23', from their end on the base plate 23*a*, are two longitudinal ribs 23*d*, 23*e*, which extend in the longitudinal direction (see arrow I) of the carrying element 23', this corresponding substantially to the width of the cylinder 4 and being, for example, 1 m. The other end of each of the longitudinal ribs 23*d*, 23*e* opposite the base plate 23*a* is free. As a result of the longitudinal ribs 23*d*, 23*e*, the overall inner hollow space of the carrying element 23' is sub-divided into three hollow sub-spaces 23$g_1$, 23$g_2$, 23$g_3$. The hollow sub-spaces 23$g_1$, 23$g_2$, 23$g_3$ are not enclosed; instead, each has an opening 23$f_1$, 23$f_2$ and 23$f_3$, respectively, which is arranged in a region of the carrying element 23' remote from the tips or circle of tips (see FIG. 2) of the clothing strips 20*a*', 20*b*' (see FIG. 2) that may be provided on the lower face of base plate 23*a*.

Figure 4:
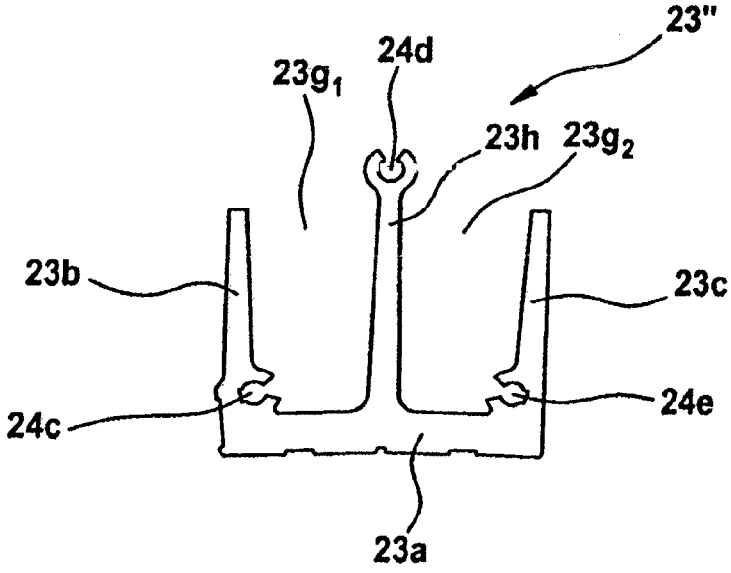
FIG. 4 is a sectional side view of a carrying element having one longitudinal rib in the interior (hollow space).

In the embodiment of FIG. 4, one longitudinal rib 23*h* is provided in the interior 23*g* (hollow space) of the carrying element 23", which rib rises up from the base plate 23*a* and divides up the interior 23*g* into two hollow sub-spaces 23$g_1$, 23$g_2$ of equal size. The hollow sub-spaces 23$g_1$, 23$g_2$ have two openings 23$f_1$, 23$f_2$ (not indicated in FIG. 4, but analogously positioned to the openings 23$f_1$, 23$f_2$, 23$f_1$, 23$f_3$ of FIG. 3) in the region opposite the base plate 23*a*, that is to say in the region of the free ends of the side walls 23*b*, 23*c* and of the longitudinal ribs 23*h*.

In the embodiments described, the carrying elements 23', 23" (profiled carrier members) may be of one-piece construction and consist of a profiled member of extruded aluminum.

Reference numerals 24*a* to 24*e* denote longitudinal recesses open to one side (slot-shaped), which are introduced in the process of extrusion and which serve to accommodate fixing elements (not shown), for example screws, for the fixed carding element 20', 20".

Whilst there have been described above certain embodiments for use in a flat card as shown in FIG. 1, the invention may also be used in connection with other textile machines, for example roller cards.

Although the foregoing invention has been described in detail by way of illustration and example for purposes of understanding, it will be obvious that changes and modifications may be practiced within the scope of the appended claims.

What is claimed is:

1. An apparatus for use at a carding machine, comprising:

a carrying element, the carrying element including a base plate including a first surface and a second surface; and a plurality of side walls extending from the second surface of the base plate, wherein the second surface of the base plate and the side walls define an inner hollow space, and wherein the side walls define an opening remote from the second surface of the base plate and the opening communicates with the inner hollow space; and a clothing element coupled to the first surface of the base plate, wherein the clothing element includes a clothing strip with tips configured to lie opposite tips of a cylinder clothing.

2. An apparatus according to claim 1, in which the carrying element comprises a semi-hollow profiled member.

3. An apparatus according to claim 1, in which a cross-section of the carrying element is substantially U-shaped.

4. An apparatus according to claim 1, in which the opening extends from the inner hollow space to the outside surrounding atmosphere.

5. An apparatus according to claim 1, in which the opening extends continuously over a width of the carding machine.

6. An apparatus according to claim 1, wherein the opening comprises an elongate configuration.

7. An apparatus according to claim 1, wherein the inner hollow space and/or the opening is sub-divided into a plurality of openings.

8. An apparatus according to claim 1, in which the side walls comprise longitudinally extending side walls and ends of the side walls away from the second surface of the base plate define opposed end openings.

9. An apparatus according to claim 1, in which the carrying element comprises two side walls.

10. An apparatus according to claim 1, wherein the carrying element comprises an extruded, profiled element of aluminum or an aluminum alloy.

11. An apparatus according to claim 1, comprising at least one rib arranged in an interior of the inner hollow space.

12. An apparatus according to claim 11, in which the rib extends in a longitudinal direction of the carrying element.

13. An apparatus according to claim 1, wherein a material cross-section of the carrying element gives rise to a substantially homogenous temperature distribution with a small thermal gradient.

14. An apparatus according to claim 13, wherein the carrying element includes an optimised mass distribution whereby the mass of the carrying element to be heated becomes less towards the outside.

15. An apparatus according to claim 1, wherein material for the carrying element has a high thermal conductivity.

16. An apparatus according to claim 1, wherein material for the carrying element has a high heat capacity.

17. An apparatus according to claim 1, in which material for the carrying element has a low coefficient of linear expansion.

18. An apparatus at a carding machine for cotton, synthetic fibres and the like, comprising:

at least one stationary carding element including:

a carrying element associated with a clothed roller, the carrying element including a base plate including a first surface and a second surface; and a plurality of side walls extending from the second surface of the base plate, wherein the second surface of the base plate and the side walls define an inner hollow space, and wherein the side walls define an opening remote from the second surface of the base plate and the opening communicates with the inner hollow space; and a clothing element coupled to the first surface of the base plate, wherein the clothing element includes a clothing strip with tips configured to lie opposite tips of the clothed roller.

19. An apparatus at a carding machine having a clothed roller, wherein the apparatus comprises:

an elongate member having opposed ends and including:

a base plate extending longitudinally between the opposed ends and including a first surface and a second surface; and a plurality of longitudinal lateral elements extending from the second surface of the base plate, wherein the second surface of the base plate and the lateral elements define an inner hollow space, wherein the lateral elements laterally close the inner hollow space and define an opening remote from the second surface of the base plate, the opening communicating with the inner hollow space, and wherein through the opening the inner hollow space communicates with the outside atmosphere; and a clothing element coupled to the first surface of the base plate, wherein the clothing element includes a clothing strip.

* * * * *